US010090648B1

(12) United States Patent
Saito et al.

(10) Patent No.: US 10,090,648 B1
(45) Date of Patent: Oct. 2, 2018

(54) SPARK PLUG

(71) Applicant: NGK SPARK PLUG CO., LTD., Nagoya-shi, Aichi (JP)

(72) Inventors: Hirotaka Saito, Komaki (JP); Naoyuki Mukoyama, Nisshin (JP)

(73) Assignee: NGK SPARK PLUG CO., LTD., Aichi (JP)

( * ) Notice: Subject to any disclaimer, the term of this patent is extended or adjusted under 35 U.S.C. 154(b) by 0 days.

(21) Appl. No.: 15/927,533

(22) Filed: Mar. 21, 2018

(30) Foreign Application Priority Data

Mar. 28, 2017 (JP) ..... 2017-062043

(51) Int. Cl.
*H01T 13/34* (2006.01)
*H01T 13/39* (2006.01)
*H01T 13/50* (2006.01)
*H01T 13/02* (2006.01)

(52) U.S. Cl.
CPC ..... *H01T 13/34* (2013.01); *H01T 13/02* (2013.01); *H01T 13/39* (2013.01); *H01T 13/50* (2013.01)

(58) Field of Classification Search
CPC ..... H01T 13/34; H01T 13/36; H01T 13/02
See application file for complete search history.

(56) References Cited

U.S. PATENT DOCUMENTS 4,071,800 A * 1/1978 Atkins ..... H01T 13/465 313/123
5,210,458 A * 5/1993 McDougal ..... H01T 13/40 313/130
5,405,280 A * 4/1995 Polikarpus ..... H01T 13/54 264/615
6,557,508 B2 * 5/2003 Labarge ..... H01T 13/50 123/169 EL
8,278,808 B2 * 10/2012 Lykowski ..... H01T 13/38 313/141
9,035,562 B2 * 5/2015 Katsuraya ..... H01T 13/20 313/118
9,929,541 B2 * 3/2018 Saito ..... H01T 13/36
2014/0026848 A1 1/2014 Abe et al.
2014/0210336 A1 7/2014 Yamada et al.
2016/0369764 A1 * 12/2016 Ban ..... H01T 13/52

FOREIGN PATENT DOCUMENTS

JP 56020929 A * 2/1981 ..... F23Q 7/001
JP 2013-186998 A 9/2013
JP 2014-022341 A 2/2014

OTHER PUBLICATIONS

Extended European Search Report issued for corresponding European Patent Application No. 18163686.1, dated Jul. 11, 2018.

* cited by examiner

*Primary Examiner* — Mariceli Santiago
(74) *Attorney, Agent, or Firm* — Kusner & Jaffe

(57) ABSTRACT

A spark plug including a bottomed tubular insulator, a tubular metal shell, a conductive layer, and a terminal. The insulator extends along an axial line from a front end side to a rear end side and is closed at a front end. The metal shell has a ledge portion that projects radially inward and locks the insulator from the front end side. The metal shell holds the insulator from an outer peripheral side. The conductive layer covers at least a part of an inner peripheral surface of a portion of the insulator which is located on the front end side with respect to a locking portion locked by the ledge portion. The terminal is electrically connected to the conductive layer and is insulated from the metal shell.

16 Claims, 5 Drawing Sheets

SPARK PLUG

FIELD OF THE INVENTION

The present invention relates to a spark plug, and more particularly, to a spark plug that uses a non-equilibrium plasma.

BACKGROUND OF THE INVENTION

As a spark plug configured to ignite an air-fuel mixture, a spark plug that uses a non-equilibrium plasma is provided (Japanese Unexamined Patent Application Publication No. 2014-22341). In the spark plug disclosed in Japanese Unexamined Patent Application Publication No. 2014-22341, a metal shell holds a bottomed tubular insulator into which a center electrode is inserted. In this spark plug, when an AC voltage is applied between the metal shell and the center electrode or a pulse voltage is applied a plurality of times therebetween, electric charge generated based on a dielectric constant of the spark plug moves to the surface of the insulator and a gas around the insulator is ionized (a non-equilibrium plasma is generated around the insulator). Thus, the air-fuel mixture is ignited.

In the related art described above, however, a clearance is provided between the inner peripheral surface of the bottomed tubular insulator and the center electrode in order to secure efficiency of insertion of the center electrode into the insulator at the time of manufacturing the spark plug. The clearance, that is, an air layer formed between the insulator and the center electrode, is arranged between the center electrode and the metal shell in series with the insulator. Therefore, an apparent dielectric constant of the spark plug decreases. As a result, a problem arises in that the amount of electric charge generated on the surface of the insulator decreases relative to electric power input to the spark plug (a loss occurs).

The present invention has been made to address the problem described above and provides a spark plug in which the ignitability can be improved by suppressing a loss of energy.

SUMMARY OF THE INVENTION

According to a first aspect of the present invention, there is provided a spark plug that includes a bottomed tubular insulator, a tubular metal shell, a conductive layer, and a terminal. The insulator extends along an axial line from a front end side to a rear end side and is closed at a front end. The metal shell has a ledge portion that projects radially inward and locks the insulator from the front end side. The metal shell holds the insulator from an outer peripheral side. The conductive layer covers at least a part of an inner peripheral surface of a portion of the insulator which is located on the front end side with respect to a locking portion locked by the ledge portion. The terminal is electrically connected to the conductive layer and is insulated from the metal shell.

In the spark plug according to the first aspect, at least the part of the inner peripheral surface of the portion of the insulator which is located on the front end side with respect to the locking portion locked by the ledge portion is covered with the conductive layer and the terminal insulated from the metal shell is electrically connected to the conductive layer. When the spark plug is installed on an internal combustion engine, the insulator which is located on the front end side with respect to the locking portion is exposed to a combustion chamber and a non-equilibrium plasma generated around the insulator is used for ignition of an air-fuel mixture. The inner peripheral surface of the insulator at that part is covered with the conductive layer and no air layer is arranged between the conductive layer and the insulator. Therefore, influence of the air layer on the ignitability can be suppressed. Thus, the ignitability can be improved by suppressing the loss of energy.

In accordance with a second aspect of the present invention, there is provided a spark plug as described above, wherein the conductive layer covers at least a part of the inner peripheral surface which is located at the front end. In addition to the advantage of the first aspect, the non-equilibrium plasma can be generated at least at a position closer to the center of the combustion chamber. As a result, the ignitability can further be improved.

In accordance with a third aspect of the present invention, there is provided a spark plug as described above, wherein the conductive layer covers an entire part of the inner peripheral surface. In addition to the advantage of the first or second aspect, the amount of the gas to be ionized around the insulator can be increased.

In accordance with a fourth aspect of the present invention, there is provided a spark plug as described above, wherein a member having thermal conductivity is inserted into the insulator. A front end of the member is located on the front end side with respect to the locking portion. In addition to the advantage of any one of the first to third aspects, heat of the insulator which is located on the front end side with respect to the locking portion is transferred to the member and thus the heat dissipation performance for the insulator can be improved.

In accordance with a fifth aspect of the present invention, there is provided a spark plug as described above, wherein a part of the member is brought into contact with a part of the insulator which is located on the rear end side with respect to a front end of the locking portion. Therefore, heat of the member can be transferred to the insulator. The heat of the member can easily be transferred to the insulator and thus the heat dissipation performance for the insulator can further be improved in addition to the advantage of the fourth aspect.

In accordance with a sixth aspect of the present invention, there is provided a spark plug as described above, wherein the member is brought into contact with at least a part of the insulator which is located on the front end side with respect to the locking portion. Therefore, the heat of the insulator can be transferred to the member. Thus, the heat of the insulator can easily be transferred to the member in addition to the advantage of the fourth or fifth aspect.

DETAILED DESCRIPTION OF THE INVENTION

Figure 1:
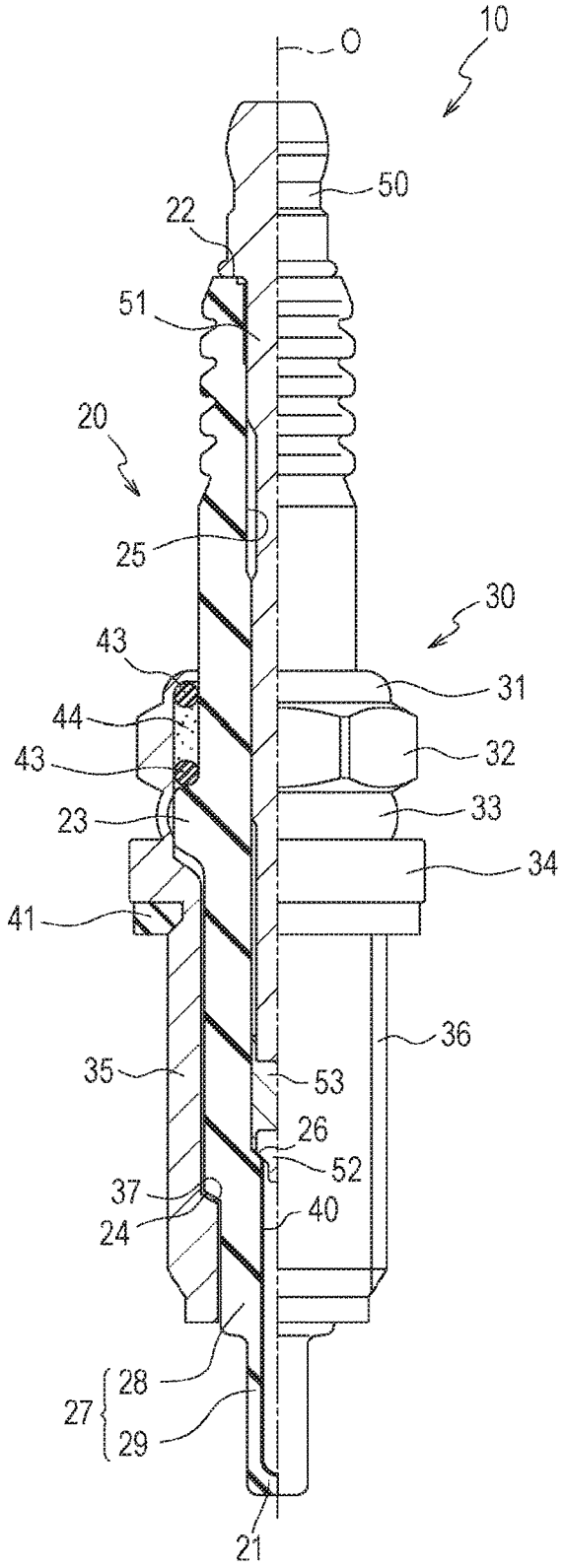
FIG. 1 is a one-side sectional view of a spark plug according to a first embodiment of the present invention.
Figure 2:
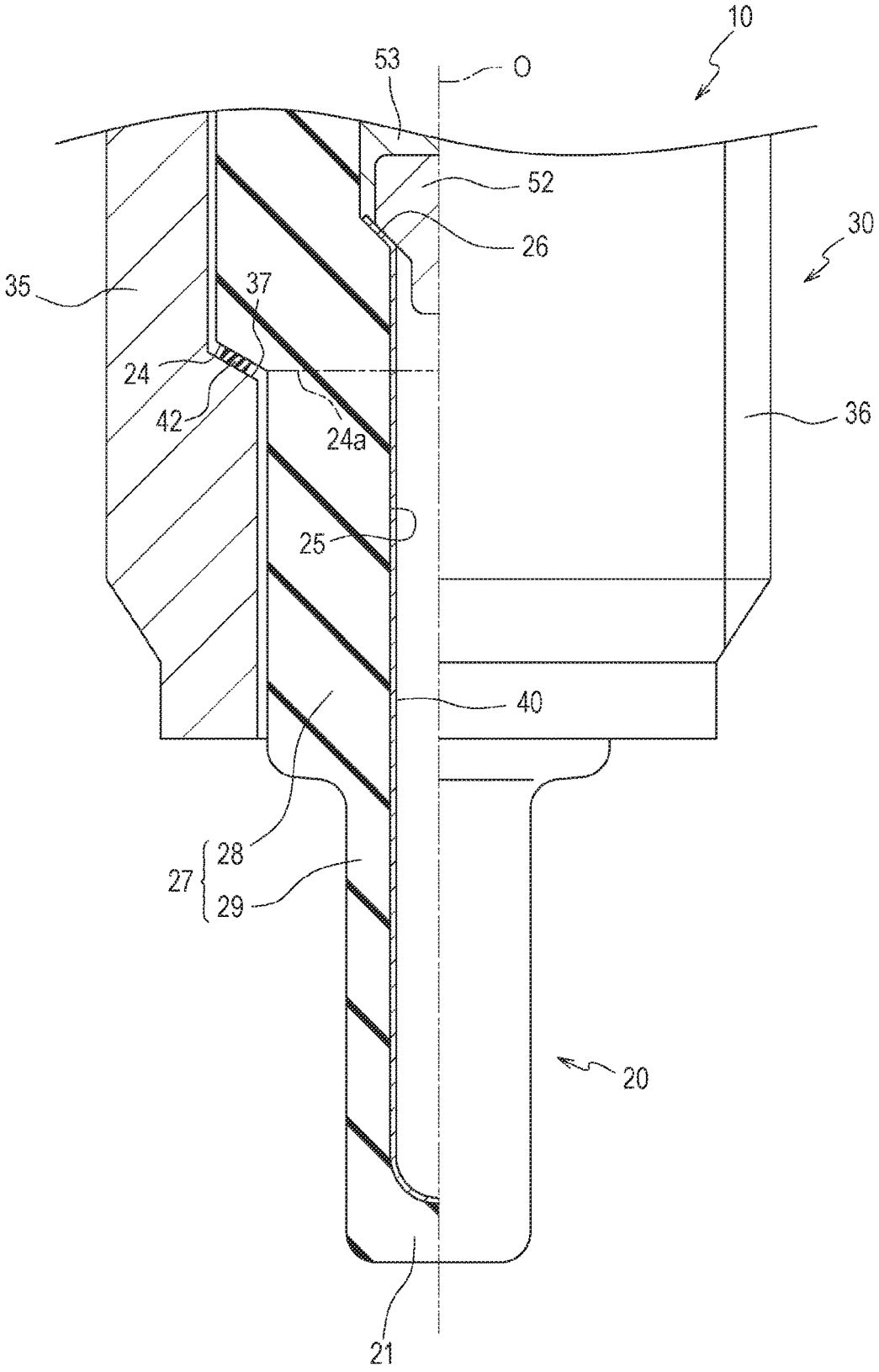
FIG. 2 is a one-side sectional view of the spark plug, illustrating a front end in an enlarged manner.

Preferred embodiments of the present invention are described below with reference to the accompanying drawings. FIG. 1 is a one-side sectional view of a spark plug 10 across an axial line O according to a first embodiment of the present invention. FIG. 2 is a one-side sectional view of the spark plug 10, illustrating a front end in an enlarged manner. In FIG. 1 and FIG. 2, the lower side of the drawing sheet is referred to as a front end side of the spark plug 10 and the upper side of the drawing sheet is referred to as a rear end side of the spark plug 10 (the same applies to FIG. 3 to FIG. 5). In FIG. 2, the illustration of the rear end side of the spark plug 10 is omitted (the same applies to FIG. 3 and FIG. 5).

As illustrated in FIG. 1, the spark plug 10 includes an insulator 20 and a metal shell 30. The insulator 20 is a bottomed cylindrical member that is closed at a front end 21, and extends from the front end 21 side to a rear end 22 side along the axial line O. The insulator 20 is formed of, for example, alumina that is excellent in mechanical properties and insulation properties under high temperature. A ring-shaped collar portion 23 that projects radially outward is provided at the center of the insulator 20 in a direction of the axial line O. A locking portion 24 having an outside diameter decreasing toward the front end 21 side is formed on an outer periphery of the insulator 20 which is located on the front end side with respect to the collar portion 23.

An inner peripheral surface 25 of the insulator 20 is open to the rear end 22 of the insulator 20. On the inner peripheral surface 25 of the insulator 20, a stepped portion 26 that projects radially inward is formed on the rear end 22 side with respect to the locking portion 24. The stepped portion 26 has a diameter decreasing toward the front end 21 side. The metal shell 30 is fixed to the outer periphery of the insulator 20.

The metal shell 30 is a substantially cylindrical member to be fixed to a threaded hole of an internal combustion engine (not illustrated), and is formed of a metal material (for example, low-carbon steel) having electric conductivity. The metal shell 30 has a crimping portion 31, a tool engaging portion 32, a curved portion 33, a seat portion 34, and a trunk portion 35 that are continuously connected in the order from the rear end side to the front end side along the axial line O. The trunk portion 35 has a threaded portion 36 formed on the outer peripheral surface thereof.

The crimping portion 31 and the curved portion 33 are portions for attaching the metal shell 30 to the insulator 20. The tool engaging portion 32 is a portion where a tool such as a wrench is engaged when the threaded portion 36 is coupled to the threaded hole of the internal combustion engine (not illustrated). The seat portion 34 is a portion that is located on the rear end side of the trunk portion 35 and projects radially outward in an annular shape. An annular gasket 41 is arranged between the seat portion 34 and the trunk portion 35. When the threaded portion 36 is engaged with the threaded hole (not illustrated), the gasket 41 is sandwiched between the seat portion 34 and the internal combustion engine (not illustrated) to seal a clearance between the threaded hole and the threaded portion 36.

A ledge portion 37 that projects radially inward is formed over the entire periphery of the trunk portion 35. The ledge portion 37 has a bore diameter decreasing toward the front end side. The ledge portion 37 is a portion that locks the insulator 20 at the locking portion 24. In this embodiment, a packing 42 (see FIG. 2) is arranged between the ledge portion 37 and the locking portion 24. The packing 42 is a ring-shaped sheet member formed of a metal material such as a mild steel sheet, which is softer than the metal material for the metal shell 30.

The ledge portion 37 of the metal shell 30 locks the locking portion 24 of the insulator 20 from the front end 21 side. Thus, a front end portion 27 of the insulator 20 projects toward the front end side with respect to the ledge portion 37. The front end portion 27 includes a first portion 28 and a second portion 29 that is continuously connected to the front end side of the first portion 28 and has an outside diameter smaller than that of the first portion 28. At least a part of the inner peripheral surface 25 of the front end portion 27 of the insulator 20 is covered with a conductive layer 40.

A pair of ring members 43 and a filler 44 such as talc that is interposed between the ring members 43 are arranged between the inner periphery of the tool engaging portion 32 of the metal shell 30 and the outer periphery of the insulator 20 which is located on the rear end 22 side of the collar portion 23. When the crimping portion 31 of the metal shell 30 is crimped in the radially inward direction toward the insulator 20, the locking portion 24 is pressed toward the ledge portion 37 of the metal shell 30 via the ring members 43, the filler 44, and the collar portion 23. As a result, the metal shell 30 fixes the insulator 20 via the packing 42, the ring members 43, and the filler 44. The second portion 29 of the insulator 20 fixed by the metal shell 30 projects from the front end of the metal shell 30.

A metal terminal 50 is a rod-shaped member to which an AC voltage or a pulse voltage is input, and is formed of a metal material (for example, low-carbon steel) having electric conductivity. The front end side of the metal terminal 50 is arranged inside the insulator 20. In this embodiment, the metal terminal 50 includes a press-fitting portion 51 that is press-fitted to the insulator 20. The metal terminal 50 is insulated from the metal shell 30.

A connecting portion 52 is locked by the stepped portion 26 of the insulator 20 while being pressed against the stepped portion 26. The connecting portion 52 is formed of a metal material (for example, low-carbon steel) having electric conductivity. The connecting portion 52 is connected to the metal terminal 50 by a conductive member 53 such as a conductive glass or a conductive adhesive having a molten composition containing, for example, $B_2O_3$—$SiO_2$-based glass particles and metal powder.

As illustrated in FIG. 2, the bore diameter of the inner peripheral surface 25 of the front end portion 27 of the insulator 20 which is located on the front end side with respect to a boundary 24*a* defined on the front end side of the locking portion 24 is uniform over the total length of the front end portion 27, except for the front end 21. At least a part of the inner peripheral surface 25 of the front end portion 27 of the insulator 20 is covered with the conductive layer 40. The conductive layer 40 is a layer that has electric conductivity and is coupled to the inner peripheral surface 25 of the insulator 20 by a chemical or physical force. In this embodiment, the entire part of the inner peripheral surface 25 which ranges from the front end 21 to the stepped portion 26 is covered with the conductive layer 40.

The conductive layer 40 is formed by, for example, plating or coating, thermal spraying, or deposition of a conductive resin material such as conductive paste. In this embodiment, the conductive layer 40 is formed by electroless nickel plating. The connecting portion 52 is brought into contact with a part of the conductive layer 40 which is formed on the stepped portion 26. Thus, the metal terminal 50 is electrically connected to the conductive layer 40.

The spark plug 10 is manufactured by, for example, the following method. First, the conductive layer 40 is formed on the inner peripheral surface 25 of the insulator 20. Next, the connecting portion 52 is locked by the stepped portion 26 and then the metal terminal 50 is fixed to the insulator 20 while securing electric connection between the connecting portion 52 and the metal terminal 50 by the conductive member 53. Finally, the metal shell 30 is assembled to the outer periphery of the insulator 20 to obtain the spark plug 10.

When the spark plug 10 is installed on the internal combustion engine (not illustrated), the front end portion 27 of the insulator 20 which is located on the front end side with respect to the locking portion 24 is exposed to a combustion chamber. The inner peripheral surface 25 of the front end portion 27 is covered with the conductive layer 40. The spark plug 10 is a type of capacitor in which the conductive layer 40 and the metal shell 30 are partitioned by the insulator 20. Therefore, when an AC voltage is applied between the metal terminal 50 and the metal shell 30 or a pulse voltage is applied a plurality of times therebetween, dielectric barrier discharge occurs in the front end portion 27. The dielectric barrier discharge causes the spark plug 10 to ionize a gas (air-fuel mixture) into a non-equilibrium plasma state, thereby generating a flame kernel in the air-fuel mixture.

In the spark plug 10, the inner peripheral surface 25 of the front end portion 27 is covered with the conductive layer 40 coupled to the inner peripheral surface 25 by a chemical or physical force, thereby being capable of eliminating a clearance (air layer) between the conductive layer 40 and the insulator 20 (front end portion 27). When the clearance (air layer) is present between the insulator 20 and the center electrode that faces the metal shell 30 across the insulator 20 as in the technology disclosed in Japanese Unexamined Patent Application Publication No. 2014-22341, an apparent dielectric constant of the spark plug 10 decreases. Accordingly, the amount of electric charge stored on the surface of the insulator 20 decreases. As a result, a problem arises in that output power (plasma generation amount) decreases relative to electric power input to the spark plug 10, that is, a loss of energy occurs. According to this embodiment, influence of the clearance (air layer) between the conductive layer 40 and the insulator 20 on the apparent dielectric constant can be suppressed, thereby being capable of suppressing the loss of energy.

The inner peripheral surface 25 of the insulator 20 is covered with the conductive layer 40 and therefore the apparent dielectric constant of the spark plug 10 hardly decreases. Thus, when the electric power input to the spark plug 10 is constant, electric charge close to a design value is stored on the surface of the insulator 20. Accordingly, the power to be output from the spark plug 10 can be increased. Further, the efficiency of the spark plug 10 is improved and therefore the electric power to be input to the spark plug 10 can be reduced when output power substantially equal to that of the related art is obtained.

In the spark plug 10, the conductive layer 40 covers at least a part of the inner peripheral surface 25 which is located at the front end 21, thereby being capable of ionizing at least the gas around the front end 21 of the insulator 20. A non-equilibrium plasma can be generated at a position closer to the center of the combustion chamber (not illustrated) and therefore the ignitability can further be improved. Further, the conductive layer 40 of the spark plug 10 covers the entire part of the inner peripheral surface 25 of the front end portion 27, thereby being capable of increasing the amount of the gas to be ionized around the front end portion 27.

In the spark plug 10, the bore diameter of the inner peripheral surface 25 of the front end portion 27 is uniform over the total length and therefore the wall thickness of the second portion 29 can be set smaller than the wall thickness of the first portion 28. Thus, the amount of electric charge to be stored on the outer peripheral surface of the second portion 29 can be set larger than the amount of electric charge to be stored on the outer peripheral surface of the first portion 28. When the spark plug 10 is installed on the internal combustion engine (not illustrated), the second portion 29 is arranged on an inner side (position closer to the center) of the combustion chamber (not illustrated) compared with the first portion 28. Therefore, the ignitability of the air-fuel mixture can be improved. Further, the entire second portion 29 and a part of the first portion 28 project from the metal shell 30 and therefore the second portion 29 and the first portion 28 can be exposed to the airflow in the combustion chamber. Thus, the ignitability can further be improved.

The conductive layer 40 extends up to the stepped portion 26 of the insulator 20 and the conductive layer 40 and the connecting portion 52 are brought into surface contact with each other on the stepped portion 26 in the direction of the axial line O. The connecting portion 52 and the metal terminal 50 adhere to each other by the conductive member 53, thereby being capable of securing the reliability of connection between the metal terminal 50 and the conductive layer 40.

In a cross section taken along a plane orthogonal to the axial line O, the sectional area of the conductive layer 40 is much smaller than the sectional area of the metal terminal 50. Therefore, the length of the conductive layer 40 in the direction of the axial line O is set smaller than the length of the metal terminal 50 in the direction of the axial line O. As a result, the resistance value of the electrode system constituted by the metal terminal 50 and the conductive layer 40 can be prevented from becoming excessively high. Thus, a voltage drop can be made less likely to occur in the electrode system constituted by the metal terminal 50 and the conductive layer 40. Therefore, a potential difference can be made less likely to occur between the rear end of the metal terminal 50 and the conductive layer 40. Accordingly, the loss relative to the electric power input to the spark plug 10 can be made less likely to occur.

Figure 3:
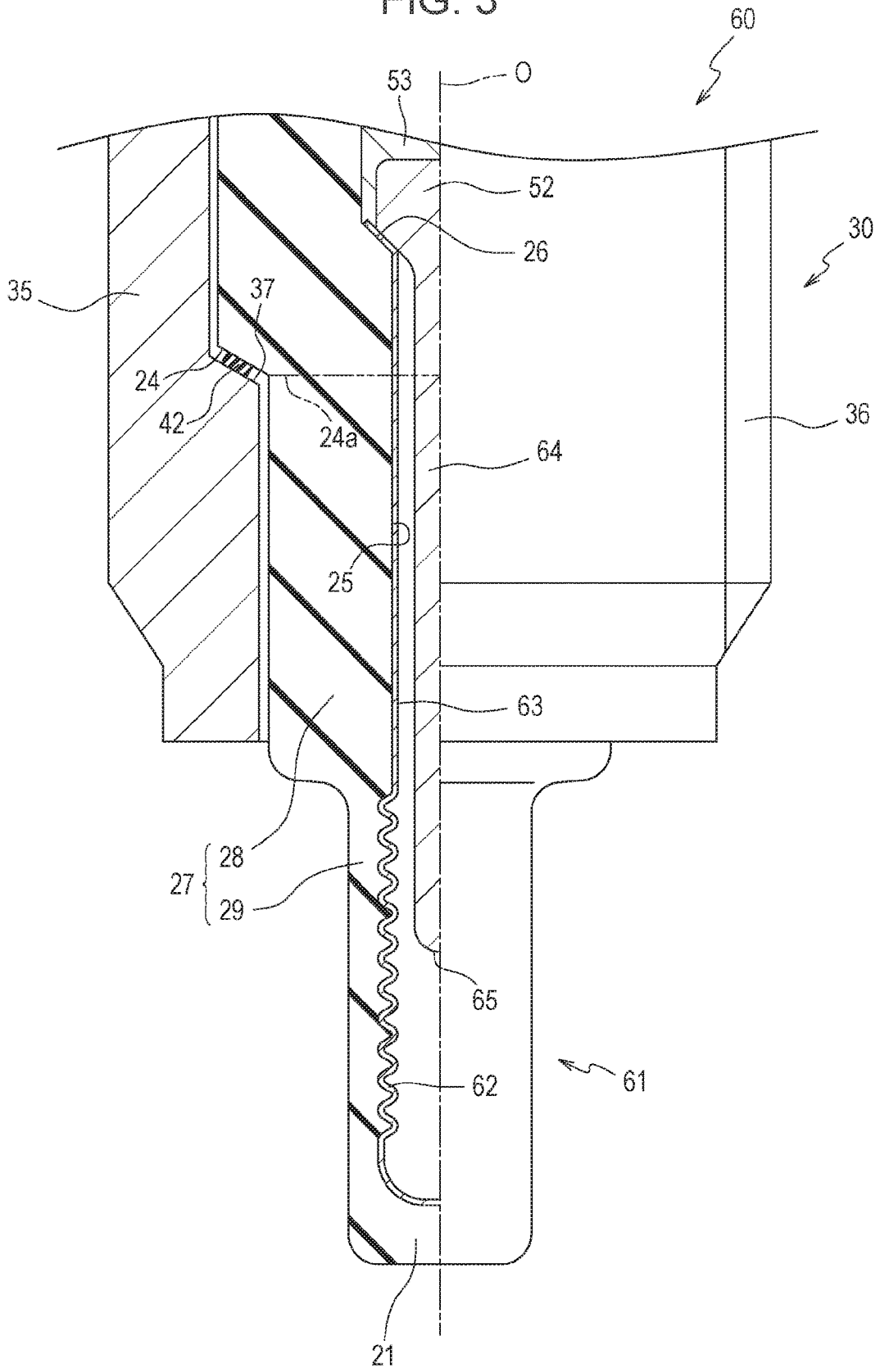
FIG. 3 is a one-side sectional view of a spark plug according to a second embodiment.

Next, a second embodiment is described with reference to FIG. 3. The first embodiment is directed to the case in which the bore diameter of the inner peripheral surface 25 of the front end portion 27 of the insulator 20 is uniform over the direction of the axial line O (except for the front end 21). The second embodiment is directed to a case in which the inner peripheral surface 25 has unevenness. The same parts as the parts described in the first embodiment are denoted by the same reference symbols to omit description thereof hereinafter. FIG. 3 is a one-side sectional view of a spark plug 60 according to the second embodiment.

As illustrated in FIG. 3, an insulator 61 is held by the metal shell 30 in the spark plug 60. The insulator 61 has an uneven portion 62 formed on the inner peripheral surface 25 of the second portion 29 of the front end portion 27. The uneven portion 62 is a portion formed to have ridges and grooves in such a manner that concentric curved walls having different bore diameters are continuously arranged in the direction of the axial line O. The uneven portion 62 is formed by cutting the inner peripheral surface of a molded product of the insulator 61 before sintering or by molding a molded product by using a core that disappears at the time of sintering.

In the insulator 61, the entire part of the inner peripheral surface 25 which includes the uneven portion 62 and ranges from the front end 21 to the stepped portion 26 is covered with a conductive layer 63. The connecting portion 52 of the metal terminal 50 is brought into contact with a part of the conductive layer 63 which is formed on the stepped portion 26. In this embodiment, the conductive layer 63 is formed by coating the inner peripheral surface 25 of the insulator 61 with conductive paste and then baking the conductive paste on the insulator 61. The conductive layer 63 is coupled to the inner peripheral surface 25 of the insulator 61 by a chemical or physical force. Therefore, the conductive layer 63 can be brought into close contact with the inner peripheral surface 25 in conformity with the shape of the inner peripheral surface 25 even in the case of such a complicated shape as that of the uneven portion 62.

In the spark plug 60, a heat receiving member 64 is continuously connected to the connecting portion 52. The heat receiving member 64 is a member to which heat of the front end portion 27 is transferred. The heat receiving member 64 suppresses overheating of the front end portion 27 of the insulator 61 through, for example, heat transfer from the front end portion 27. The heat receiving member 64 is a rod-shaped member formed of a metal (for example, low-carbon steel) which is thinner than the connecting portion 52. In this embodiment, the heat receiving member 64 is molded integrally with the connecting portion 52. Thus, the number of components can be reduced compared with a case in which the connecting portion 52 and the heat receiving member 64 are provided separately. The heat receiving member 64 is arranged on an inner side of the inner peripheral surface 25 while being kept out of contact with the conductive layer 63. A front end 65 of the heat receiving member 64 is located on the front end 21 side with respect to the boundary 24*a* defined on the front end side of the locking portion 24 of the insulator 61.

In the spark plug 60, the uneven portion 62 formed on the inner peripheral surface 25 of the second portion 29 is covered with the conductive layer 63. Therefore, the surface area of the conductive layer 63 formed on the second portion 29 can be increased compared with the first embodiment. The amount of electric charge to be stored on the surface of the insulator 61 can be increased by an amount corresponding to the increase in the surface area of the conductive layer 63. Accordingly, the plasma generation amount can be increased.

The heat receiving member 64 is arranged inside the insulator 61 and the front end 65 of the heat receiving member 64 is located on the front end 21 side with respect to the boundary 24*a* of the locking portion 24. Therefore, the heat of the front end portion 27 is transferred to the heat receiving member 64 by convection. The coefficient of thermal conductivity of the heat receiving member 64 is higher than the coefficient of thermal conductivity of air. Therefore, the heat dissipation from the front end portion 27 to the heat receiving member 64 can be facilitated compared with a case in which the heat receiving member 64 is not provided and only air is present on the inner side of the inner peripheral surface 25. In particular, the front end 65 of the heat receiving member 64 projects toward the front end side with respect to the metal shell 30 and therefore the heat transfer from the front end portion 27 to the heat receiving member 64 can be facilitated. Thus, the heat dissipation performance of the heat receiving member 64 for the front end portion 27 can be improved.

The heat receiving member 64 is integrated with the connecting portion 52 that is in contact with the insulator 61 via the conductive layer 63 formed on the surface of the stepped portion 26. Therefore, heat received by the heat receiving member 64 can be dissipated from the connecting portion 52 to the stepped portion 26 through the conductive layer 63. The stepped portion 26 is located on the rear end side (upper side in FIG. 3) with respect to the boundary 24*a* of the locking portion 24. Therefore, the heat of the front end portion 27 located on the front end side (lower side in FIG. 3) with respect to the boundary 24*a* can be dissipated to the rear end side of the insulator 61. The heat input to the stepped portion 26 is dissipated to the metal shell 30 via the packing 42. Therefore, the heat dissipation performance can further be improved.

Figure 4:
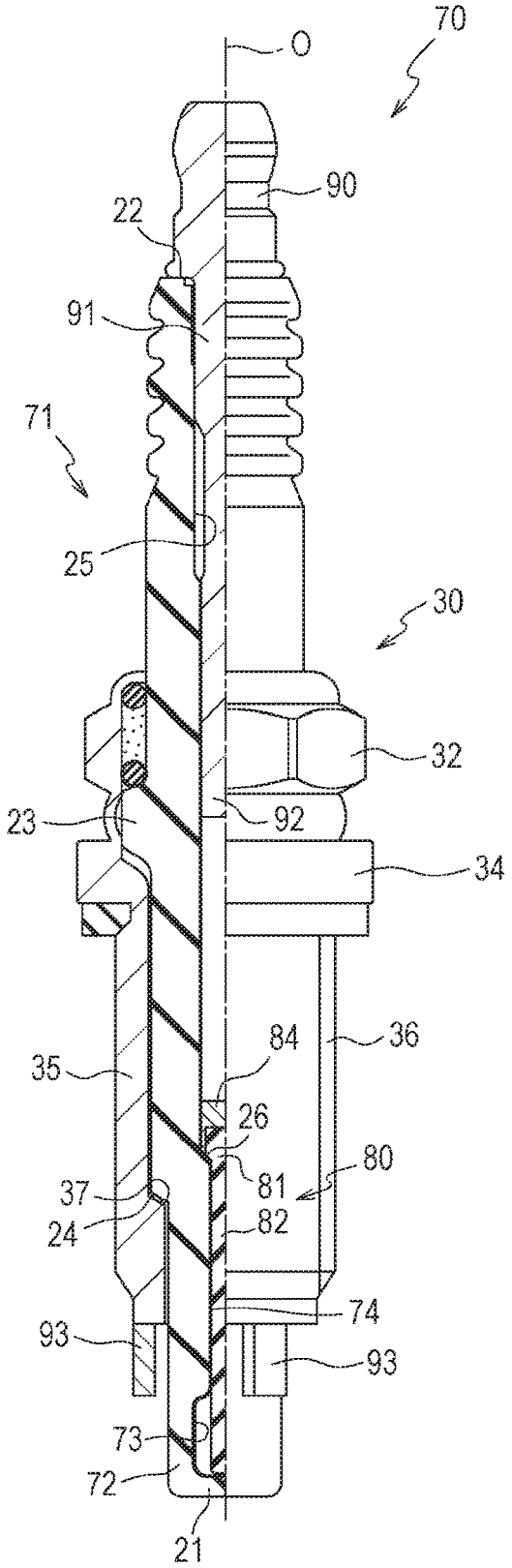
FIG. 4 is a one-side sectional view of a spark plug according to a third embodiment.
Figure 5:
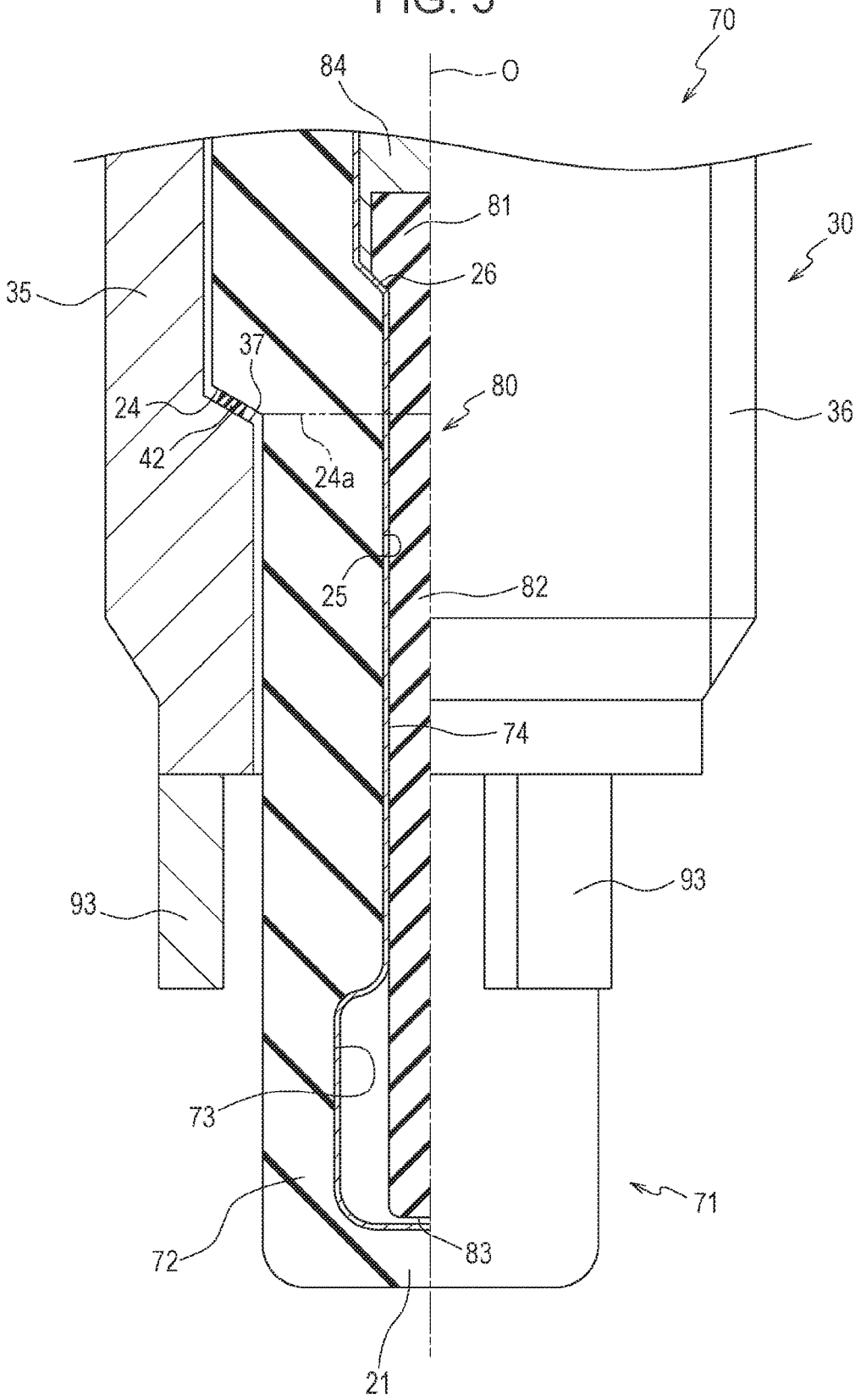
FIG. 5 is a one-side sectional view of the spark plug, illustrating a front end in an enlarged manner.

Next, a third embodiment is described with reference to FIG. 4 and FIG. 5. The second embodiment is directed to the case in which the heat receiving member 64 having electric conductivity is arranged inside the insulator 61. The third embodiment is directed to a case in which a heat receiving member 80 having insulation properties is arranged inside an insulator 71. The same parts as the parts described in the first embodiment are denoted by the same reference symbols to omit description thereof hereinafter. FIG. 4 is a one-side sectional view of a spark plug 70 according to the third embodiment. FIG. 5 is a one-side sectional view of the spark plug 70, illustrating a front end in an enlarged manner.

As illustrated in FIG. 4 and FIG. 5, the insulator 71 is held by the metal shell 30 in the spark plug 70. The outside diameter of a front end portion 72 of the insulator 71 which is located on the front end side with respect to the boundary 24*a* of the locking portion 24 is set uniform over the total length in the direction of the axial line O. A concave portion 73 is formed on the inner peripheral surface 25 at a part of the front end portion 72 which projects toward the front end side with respect to the metal shell 30. The concave portion 73 is a portion having a bore diameter larger than the bore diameter of the inner peripheral surface 25 at a part of the front end portion 72 which is arranged inside the metal shell 30. The concave portion 73 is formed by cutting the inner peripheral surface of a molded product of the insulator 71 before sintering or by molding a molded product by using a core that disappears at the time of sintering.

In the insulator 71, the entire part of the inner peripheral surface 25 which includes the concave portion 73 and ranges from the front end 21 to an inner side of a part where the rear end of the metal shell 30 is located is covered with a conductive layer 74. In this embodiment, the conductive layer 74 is formed by electroless nickel plating.

In the spark plug 70, the heat receiving member 80 is arranged on an inner side of the front end portion 72. The heat receiving member 80 is a rod-shaped insulator formed of a ceramic such as alumina or a glass ceramic. The heat receiving member 80 includes a head portion 81 locked by the stepped portion 26, and a shaft portion 82 inserted into the inner peripheral surface 25. The shaft portion 82 is brought into surface contact with the conductive layer 74 that covers the inner peripheral surface 25, except for the concave portion 73. A front end 83 of the shaft portion 82 projects toward the front end side with respect to the metal shell 30. The head portion 81 is brought into contact with the stepped portion 26 via the conductive layer 74. The head portion 81 is fixed to the stepped portion 26 by a fixing member 84 such as a composition containing, for example, $B_2O_3$—$SiO_2$-based glass particles or an inorganic adhesive (so-called cement). The fixing member 84 causes the head portion 81 of the heat receiving member 80 and the conductive layer 74 to adhere to each other while covering the head portion 81.

A metal terminal 90 (see FIG. 4) is a rod-shaped member formed of a metal material (for example, low-carbon steel) having electric conductivity. The metal terminal 90 includes a press-fitting portion 91 that is press-fitted to the insulator 71, and a connecting portion 92 having an outer periphery brought into surface contact with the conductive layer 74 that covers the inner peripheral surface 25 of the insulator 71. The connecting portion 92 extends in the direction of the axial line O up to the position of the collar portion 23 of the insulator 71. The outer periphery of the connecting portion 92 is brought into contact with the conductive layer 74 and thus the metal terminal 90 is electrically connected to the conductive layer 74. Through the electric connection between the metal terminal 90 and the conductive layer 74 that extends up to the rear end side of the insulator 71, the length of the metal terminal 90 in the direction of the axial line O can be reduced by an amount corresponding to the extension of the conductive layer 74 in the direction of the axial line O. The spark plug 70 can be reduced in the weight by an amount corresponding to the reduction in the length of the metal terminal 90 in the direction of the axial line O.

Ground electrodes 93 are provided at the front end of the metal shell 30. The ground electrode 93 is a rod-shaped electrode formed of a metal material (for example, a nickel-based alloy) having electric conductivity. The ground electrode 93 is provided in order to expand the range of spark discharge to a radially outer space of the front end portion 72 of the insulator 71. In this embodiment, three ground electrodes 93 are joined at three positions on the metal shell 30 with intervals therebetween in a circumferential direction. The ground electrode 93 extends in the direction of the axial line O up to a position of the rear end of the concave portion 73 in the direction of the axial line O, which is formed at the front end portion 72.

In the spark plug 70, the concave portion 73 formed on the inner peripheral surface 25 of the front end portion 72 is covered with the conductive layer 74. Therefore, the surface area of the conductive layer 74 formed on the front end portion 72 can be increased compared with the first embodiment by an amount corresponding to an interface part (ring-shaped part) of the concave portion 73. The amount of electric charge to be stored on the surface of the insulator 71 can be increased by an amount corresponding to the increase in the surface area of the conductive layer 74. Accordingly, the plasma generation amount can be increased.

The concave portion 73 is formed on the front end portion 72 and therefore the wall thickness of a part of the front end portion 72 where the concave portion 73 is formed can be set smaller than the wall thickness of a part of the front end portion 72 other than the part where the concave portion 73 is formed. The amount of electric charge to be stored on the insulator 71 can be increased by an amount corresponding to the reduction in the wall thickness of the front end portion 72 by the concave portion 73. Thus, the plasma generation amount can further be increased.

In the heat receiving member 80 arranged inside the insulator 71, the outer periphery of the shaft portion 82 is brought into surface contact with the conductive layer 74 that covers the inner peripheral surface 25, except for the concave portion 73. Therefore, the contact area can be increased compared with a case in which only the front end 83 of the shaft portion 82 is brought into contact with the conductive layer 74. Thus, efficient thermal conduction can be achieved from the front end portion 72 to the heat receiving member 80 and therefore the heat dissipation performance for the front end portion 72 can be improved.

In the heat receiving member 80, the head portion 81 is brought into contact with the conductive layer 74 formed on the surface of the stepped portion 26. Therefore, heat received by the shaft portion 82 can be dissipated from the head portion 81 to the stepped portion 26 through the conductive layer 74. In particular, the head portion 81 is covered with the fixing member 84 and the fixing member 84 causes the head portion 81 and the conductive layer 74 to adhere to each other. Therefore, the thermal conductivity from the head portion 81 to the stepped portion 26 via the conductive layer 74 can be improved.

The present invention has been described above based on the embodiments but is not limited to the embodiments described above. It can easily be understood that various modifications may be made without departing from the spirit of the present invention.

Each of the embodiments described above is directed to the case in which the metal terminal 50 or 90 is electrically connected to the conductive layer 40, 63, or 74. The present invention is not necessarily limited to this case. A terminal electrically connected to the conductive layer 40, 63, or 74 and insulated from the metal shell 30 may be provided in place of the metal terminal 50 or 90. For example, there may be employed a structure in which a hole passing through the insulator 20, 61, or 71 is formed in the radial direction, a conductor such as a lead wire is provided through the hole, and the terminal provided on the outer periphery of the insulator 20, 61, or 71 and the conductive layer 40, 63, or 74 are connected to each other by the conductor.

Each of the embodiments described above is directed to the case in which the entire part of the inner peripheral surface 25 of the front end portion 27 or 72 is covered with the conductive layer 40, 63, or 74. The present invention is not necessarily limited to this case. It is only necessary that at least a part of the inner peripheral surface 25 of the front end portion 27 or 72 be covered with the conductive layer 40, 63, or 74. The reason is as follows. The front end portion 27 or 72 is exposed to the combustion chamber when the spark plug 10, 60, or 70 is installed on the internal combustion engine. Therefore, the air-fuel mixture can be ignited by generating a non-equilibrium plasma around the front end portion 27 or 72.

It is more preferable that at least a part of the inner peripheral surface 25 which is located at the front end 21 be covered with the conductive layer 40, 63, or 74. The reason is as follows. When the spark plug 10, 60, or 70 is installed on the internal combustion engine, the front end 21 of the insulator 20, 61, or 71 is a part that projects most into the combustion chamber. Therefore, when the inner peripheral surface 25 at the front end 21 is covered with the conductive layer 40, 63, or 74, the air-fuel mixture around the front end 21 which is located closer to the center of the combustion chamber can be ignited by ionization.

Each of the embodiments described above is directed to the case in which the heat receiving member 64 or 80 is a rod-shaped member formed of a metal or a ceramic. The present invention is not necessarily limited to this case. It is only necessary that the heat receiving member 64 or 80 be a member that is arranged inside the insulator 20, 61, or 71 and is capable of removing heat from the front end portion 27 or 72. Therefore, the heat receiving member 64 or 80 is not limited to the rod-shaped member and powder or particles of a metal or a ceramic may be used, for example. As the heat receiving member 64 or 80, the powder or particles may be filled into the insulator 20, 61, or 71.

Each of the embodiments described above may be modified by adding a part or a plurality of parts of the structure of another embodiment to the embodiment described above or replacing the part or the plurality of parts of the structure of another embodiment with a part or a plurality of parts of the structure of the embodiment described above.

For example, the metal terminal 50 described in the first embodiment, the metal terminal 50 having the heat receiving member 64 joined thereto, which is described in the second embodiment, and the combination of the metal terminal 90 and the heat receiving member 80, which is described in the third embodiment, may be replaced with each other.

The front end portion 27 described in the first embodiment and the second embodiment and the front end portion 72 described in the third embodiment may be replaced with each other. The ground electrodes 93 described in the third embodiment may be joined to the metal shell 30 described in the first embodiment and the second embodiment.

As in the case of the heat receiving member 80 described in the third embodiment, the outside diameter of the heat receiving member 64 described in the second embodiment may be set substantially equal to the bore diameter of the inner peripheral surface 25 so that the heat receiving member 64 is brought into contact with the inner peripheral surface 25 (conductive layer 40 or 63). By bringing the heat receiving member 64 into contact with the inner peripheral surface 25 (conductive layer 40 or 63), the thermal conduction to the heat receiving member 64 can be facilitated.

Each of the first embodiment and the second embodiment is directed to the case in which the connecting portion 52 is provided separately from the metal terminal 50 and the connecting portion 52 and the metal terminal 50 are connected to each other by the conductive member 53. The present invention is not necessarily limited to this case. The metal terminal 50 and the connecting portion 52 may be integrated with each other while omitting the conductive member 53. By integrating the metal terminal 50 and the connecting portion 52 with each other, the number of components can be reduced.

The second embodiment is directed to the case in which the connecting portion 52 and the heat receiving member 64 are molded integrally. The present invention is not necessarily limited to this case. The heat receiving member 64 and the connecting portion 52 each having electric conductivity may be provided separately and joined to each other by a conductive glass or a conductive adhesive having a molten composition containing, for example, $B_2O_3$—$SiO_2$-based glass particles and metal powder. The heat receiving member 64 may be joined to the connecting portion 52 with a screw or the like. Also in those cases, operations and advantages similar to those of the second embodiment can be attained.

Each of the embodiments described above is directed to the case in which the insulator 20, 61, or 71 is formed of a single member. The present invention is not necessarily limited to this case. There may be employed a structure in which the insulator 20, 61, or 71 is divided into a part including the locking portion 24 (hereinafter referred to as "first part") and a part including the front end 21 (hereinafter referred to as "second part") and the second part is joined to the first part to constitute the insulator 20, 61, or 71.

Each of the embodiments described above is directed to the case in which the metal shell 30 is crimped onto the insulator 20, 61, or 71 via the ring members 43 and the filler 44. The present invention is not necessarily limited to this case. The metal shell 30 may be crimped while omitting the ring members 43 and the filler 44.

Having described the invention, the following is claimed:

1. A spark plug, comprising:

a bottomed tubular insulator that extends along an axial line from a front end side to a rear end side and is closed at a front end;

a tubular metal shell having a ledge portion that projects radially inward and locks the insulator from the front end side, the metal shell holding the insulator from an outer peripheral side;

a conductive layer that covers at least a part of an inner peripheral surface of a portion of the insulator which is located on the front end side with respect to a locking portion locked by the ledge portion; and a terminal that is electrically connected to the conductive layer and is insulated from the metal shell.

2. The spark plug according to claim 1, wherein the conductive layer covers at least a part of the inner peripheral surface which is located at the front end.

3. The spark plug according to claim 1, wherein the conductive layer covers an entire part of the inner peripheral surface.

4. The spark plug according to claim 1, further comprising a member that is inserted into the insulator and has thermal conductivity, wherein a front end of the member is located on the front end side with respect to the locking portion.

5. The spark plug according to claim 4, wherein a part of the member is brought into contact with a part of the insulator which is located on the rear end side with respect to a front end of the locking portion.

6. The spark plug according to claim 4, wherein the member is brought into contact with at least a part of the insulator which is located on the front end side with respect to the locking portion.

7. The spark plug according to claim 2, wherein the conductive layer covers an entire part of the inner peripheral surface.

8. The spark plug according to claim 7, further comprising a member that is inserted into the insulator and has thermal conductivity, wherein a front end of the member is located on the front end side with respect to the locking portion.

9. The spark plug according to claim 8, wherein a part of the member is brought into contact with a part of the insulator which is located on the rear end side with respect to a front end of the locking portion.

10. The spark plug according to claim 9, wherein the member is brought into contact with at least a part of the insulator which is located on the front end side with respect to the locking portion.

11. The spark plug according to claim 3, further comprising a member that is inserted into the insulator and has thermal conductivity, wherein a front end of the member is located on the front end side with respect to the locking portion.

12. The spark plug according to claim 11, wherein a part of the member is brought into contact with a part of the insulator which is located on the rear end side with respect to a front end of the locking portion.

13. The spark plug according to claim 12, wherein the member is brought into contact with at least a part of the insulator which is located on the front end side with respect to the locking portion.

14. The spark plug according to claim 2, further comprising a member that is inserted into the insulator and has thermal conductivity, wherein a front end of the member is located on the front end side with respect to the locking portion.

15. The spark plug according to claim 14, wherein a part of the member is brought into contact with a part of the insulator which is located on the rear end side with respect to a front end of the locking portion.

16. The spark plug according to claim 15, wherein the member is brought into contact with at least a part of the insulator which is located on the front end side with respect to the locking portion.

* * * * *